US005865226A

United States Patent [19]

Sweeney

[11] Patent Number: 5,865,226

[45] Date of Patent: Feb. 2, 1999

[54] SERVO MOTOR DRIVEN FILL SYSTEM

[75] Inventor: David J. Sweeney, White Bear Lake, Minn.

[73] Assignee: Tetra Laval Holdings & Finance, S.A., Pully, Switzerland

[21] Appl. No.: 702,323

[22] Filed: Aug. 23, 1996

[51] Int. Cl.[6] ..... B65B 1/04; B65B 3/04

[52] U.S. Cl. ..... 141/258; 141/261; 222/333

[58] Field of Search ..... 141/258, 259, 141/260, 261, 262; 222/333, 380; 74/104, 107, 526; 417/362, 415

[56] References Cited

U.S. PATENT DOCUMENTS

| | | | |
|---|---|---|---|
| 2,032,163 | 2/1936 | Bagby | 222/333 |
| 3,700,141 | 10/1972 | Cristiani | 222/333 |
| 3,820,303 | 6/1974 | Martensson et al. . | |
| 3,850,345 | 11/1974 | Merritt . | |
| 4,150,769 | 4/1979 | James | 222/333 |
| 4,537,230 | 8/1985 | Schindel | 141/259 |
| 5,009,339 | 4/1991 | Hanerus et al. | 141/258 |
| 5,127,449 | 7/1992 | Mueller et al. . | |

*Primary Examiner*—Steven O. Douglas
*Attorney, Agent, or Firm*—Michael A. Catania

[57] ABSTRACT

A fill system for filling a series of containers being processed on a packaging machine is set forth herein. The fill system includes a servomotor which may implement a number of stored fill profiles to provide precise filling of the containers. The servomotor is connected to one end of a cam shaft by a drive linkage. The drive linkage may be a toothed belt. The cam shaft is connected at its other end to a cam having a closed cam track. The cam directs a piston rod which controls a piston stroke in a piston chamber of the fill system. The piston chamber receives and holds of volume of product that is to be dispensed into each of the series of containers. The fill system may be integrated onto an existing packaging machine. The servomotor may be controlled by programmable logic controller.

12 Claims, 5 Drawing Sheets

2/5

SERVO MOTOR DRIVEN FILL SYSTEM

TECHNICAL FIELD

The present invention relates to a filling system for a packaging machine. More particularly, the present invention relates to a servo motor driven filling station of a packaging machine.

BACKGROUND

Packaging machines are known that integrate the various components necessary to fill and seal a container into a single machine unit. The process of packaging, generally stated, includes feeding carton blanks into the machine, sealing the bottom of the cartons, filling the cartons with a desired volume of product, sealing the top of the cartons, and then off loading the filled cartons from the machine for subsequent distribution.

The operation of the various components used to form, fill, and seal the cartons must be coordinated so that the desired function is carried out on the carton at the desire time. Known systems coordinate the movement of the various components using a main drive shaft common to the various components. Employing a common drive shaft ensures that the various components of the machine execute coordinated movements whereby specific functions executed by one component are carried out at an appropriate time with respect to the other functions executed by other components.

One example of a machine utilizing a common drive shaft is disclosed in U.S. Pat. No. 3,820,303 to Martensson et. al. The common drive shaft of the machine disclosed in the '303 patent is located below the table of the machine, and includes a variety of cams and other actuating means, such as gear boxes, that provide appropriate movement to the various machine components.

As will be appreciated, precise control of the filling system is necessary in order to assure that each container receives the desired quantity of product. In practice, such precision can be difficult to achieve. Typically, the product filling system is cam-operated, and is ordinarily mechanically linked to the common drive shaft that drives the associated container conveyor. Cam operation of the product pump of this type of system has been found to desirably provide superior volume control, when compared to pneumatic systems, and desirably consistent operation of the pump devices. This type of system desirably avoids problems associated with fluctuations in product supply pressure and air supply pressure, and imprecise operator control.

Despite certain advantages, such cam-operated systems lack versatility, since the system typically performs optimally within a limited speed range, and thus does not lend itself to running at higher or lower speeds. When the system is run at other than its optimal speed, undesirably high product reject rates result. Additionally, such systems do not readily lend themselves to changes in product volume. Each cam which is driven by the common drive shaft is only capable of driving the pumping piston through a single range of motion, resulting in delivery of a single volume of product.

The volume delivered may be altered by changing the profile of the cam used to drive the pumping piston. Systems are known which provide multiple cam profiles. These systems involve at least two limitations. First, the range of output volumes available to the machine user are limited by the availability of cam profiles. For example, if cam profiles are available for ½ pint and 1 pint volumes, the user would be unable to fill cartons of ¾ pint without ordering or machining a new cam profile. Second, even if the user has the appropriate cam profile available, the system must be shut down, and the appropriate cam profile must be manually changed to engage the appropriate cam follower.

Other systems are known where a horizontal piston rod is driven by a servomotor with a linear, screw-type actuator. This system provides a variable piston stroke that is controlled by a servomotor control system. These systems, however, include the bulk of their moving components above the cartons to be filled. They thus create the potential for contamination. Additionally, these systems are incapable of being retrofit to replace the cam structures typically used on existing machines.

SUMMARY OF THE INVENTION

A fill system for filling a container in a packaging machine is set forth that can implement any number of fill profiles in a simple, cost effective, and efficient manner. In accordance with one embodiment of the fill system, the fill system comprises a piston chamber for receiving and holding a volume of product that is to be dispensed into the container. A piston assembly comprising a piston rod and piston head are disposed in the piston chamber. The assembly is movable linearly therein along a piston stroke length. Variations in the piston stroke length vary the volume of product received and dispensed from the piston chamber. A cam follower is disposed in fixed alignment with the piston rod. Movement of the cam follower results in movement of the piston rod and piston head. A cam having a closed cam track in which the cam follower is disposed is also utilized and is connected for co-rotation with a cam shaft. A drive linkage connects a servomotor and the cam shaft. The servomotor is controlled by a control system including a plurality of stored fill profiles that can be executed to control the servomotor.

In accordance with a further embodiment of the fill system, the fill system comprises a piston chamber for receiving and holding a volume of product that is to be dispensed into the container. A piston assembly including a piston head and piston rod are disposed in the piston chamber. The piston assembly is movable linearly therein along a piston stroke length, variations in the piston stroke length varying the volume of product received and dispensed from the piston chamber. A drive linkage connects a servomotor and the piston rod. The drive linkage includes a linear portion that is generally parallel with the direction of the piston stroke length, the piston rod being connected in fixed alignment to a section of the linear portion.

DETAILED DESCRIPTION OF THE DRAWINGS

Figure 1:
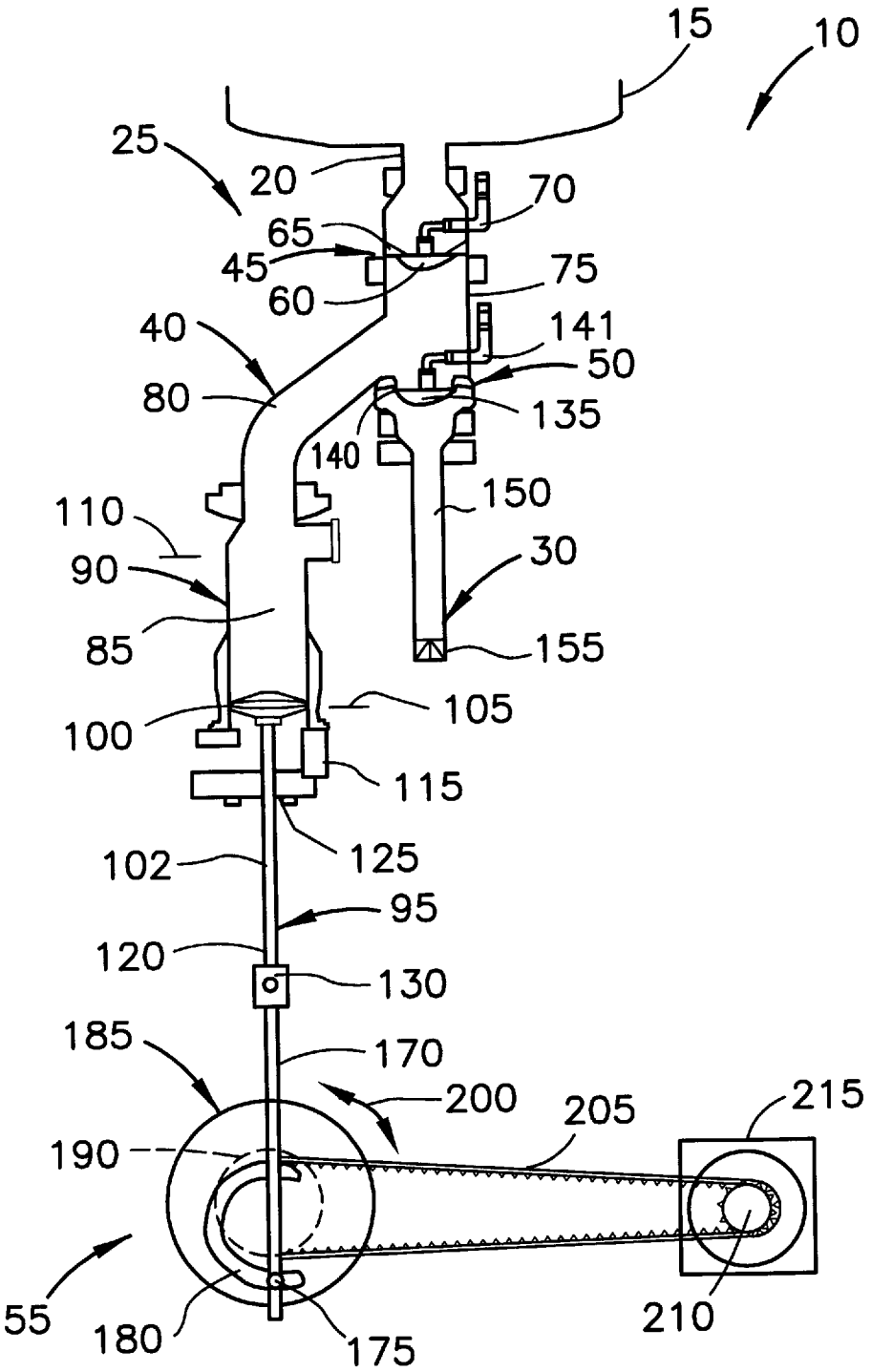
FIG. 1 is a front elevation of a filling station constructed in accordance with one embodiment of the present invention.

FIG. 1 illustrates one embodiment of a fill system, shown generally at 10, that is suitable for use in a packaging machine of the type shown in the foregoing '033 patent. Such a system may likewise be used in and retrofitted to commercially available packaging machines, such as those sold by Tetra Pak, Inc., under the trademarks TR/7™ and TR/8™.

The filling system 10 is used to introduce bulk products, such as milk and the like, into individual cartons. The bulk product is stored in large volumes in, for example, a product tank 15. The product tank 15 of the illustrated embodiment has an outlet 20 located at or near the bottom of the tank 15 such that gravity feeds the bulk product toward the outlet 20 for controlled volume measurement into a pump system, shown generally at 25, and subsequent dispensing through a dispensing assembly 30 and into a carton (not illustrated) disposed below the dispensing assembly 30.

The pump system 25 of the illustrated embodiment is of the vertically oriented type commonly employed in machines such as the previously noted TR/7 and TR/8 packaging machines. The pump system 25 includes a pump chamber 40, an inlet valve 45, an outlet valve 50, and a piston drive mechanism 55.

The inlet valve 45 includes a valve member 60 disposed in a corresponding valve seat 65. The valve member 60 is connected to be driven by a pneumatic control 70 (only partially shown) which is capable of automatically opening and closing the inlet valve 45 in response to predetermined control signals. In the closed position, inlet valve 45 prevents fluid communication between the outlet 20 of the product tank 15 and the chamber 40. When the inlet valve 45 is in an open position, product can flow through the outlet 20 of the product tank 15 and into the chamber 40.

In the illustrated embodiment, the piston chamber 40 includes a first portion 75 disposed vertically between the inlet and outlet valves 45 and 50, a crossover portion 80, and a piston chamber 85. The interior walls of a piston housing 90 define the piston chamber 85. A pump piston 95 is positioned within piston chamber 85 and includes a piston head 100 that sealingly engages the walls of the piston chamber 85. The piston head 100 is attached to a piston rod 102 and is capable of moving through the piston chamber 85 between a lower piston position 105 and an upper piston position 110.

Piston rod 102 has an upper end 115 and a lower end 120. The upper end 115 of the piston rod 102 passes through an aperture 125 in the bottom of the pump housing 90 to connect to the piston head. 100. The piston rod 102 is capable of vertical movement through the aperture 125. The lower end 120 of the piston rod 102 is connected by, for example, a mechanical link 130, to the drive mechanism 55.

The outlet valve 50 is located at the bottom of first chamber 75 and includes a valve member 135 disposed in a corresponding valve seat 140. The outlet valve 50 is attached to pneumatic control 141 (only partially shown) which is capable of automatically opening and closing the outlet valve 50 in response to predetermined control signals. When closed, the outlet valve 50 creates a tight seal that prevents product from exiting the chamber portion 75. When open, the outlet valve 50 allows communication of the product from the chamber portion 75 to the dispensing assembly 30.

The dispensing assembly 30 includes a fill pipe 150 that is, for example, secured with the pump system 25, to receive the product from the first chamber 75. A nozzle 155, such as a flexible nozzle, is disposed over an outlet portion 160 of the fill pipe 150 and controls product flow from the fill pipe 150 into the carton. The nozzle may be a flexible nozzle that is pressure actuated by the action of the pump mechanism 25.

Of particular note in connection with the present invention is the drive mechanism 55 that drives the piston 95. As illustrated, the drive mechanism 55 includes a shaft 170 having an upper portion connected to the link 130 and a lower portion connected to a cam follower 175. The cam follower 175 engages a cam surface 180 of a cam 185. In the illustrated embodiment, the cam 185 is a spiral cam having a spiralled cam surface 180.

The cam 185 is connected to a cam shaft 190. The cam shaft 190 is driven in the direction of arrows 200 by a cam drive mechanism that includes a drive linkage 205 disposed between a drive shaft 210 of a servomotor 215 and the cam shaft 190. The driving of the cam shaft 190 is preferably fashioned as a reciprocating drive.

The drive linkage 205 can take on any number of forms, such as a chain or friction belt. Preferably, however, the linkage 205 is in the form of a toothed belt that engages corresponding toothed surfaces of the cam shaft 190 and servomotor drive shaft 210.

When the servomotor 215 is driven, the rotation of the servomotor drive shaft 210 results in a corresponding rotation of the cam shaft 190 and the cam 185. Rotation of spiral cam 185, in turn, causes linear motion of the piston assembly 95 through the piston chamber 85. It will be appreciated that the piston stroke length as well as the motion profile executed over the stroke length may be varied by varying the rotation imparted to the cam shaft 190 by the servomotor 215. As such, extremely accurate and varied filling profiles may be obtained.

Figure 2:
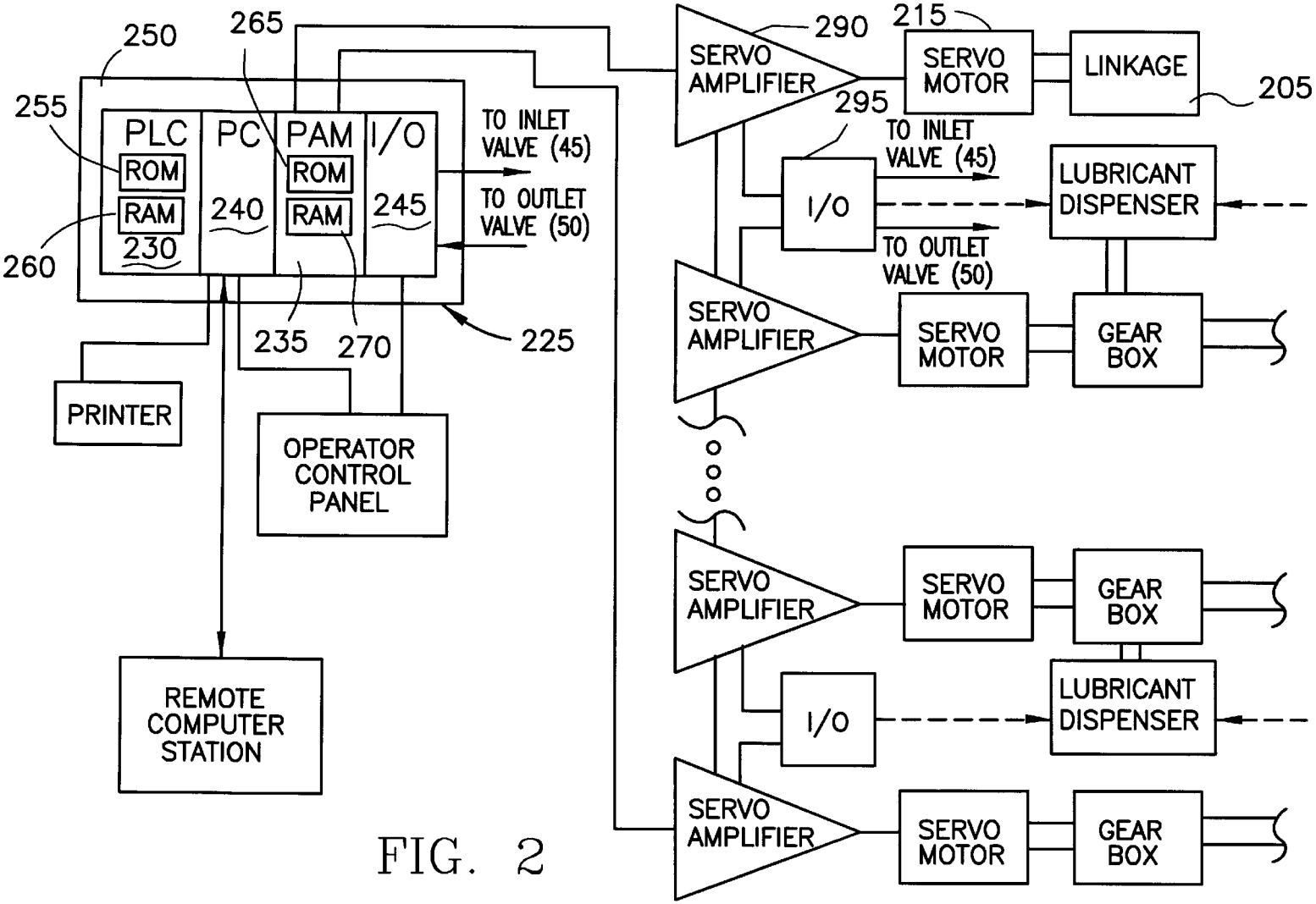
FIG. 2 is a block schematic diagram of one embodiment of a control system suitable for controlling the servomotors of the disclosed embodiments of the invention.

Although there are any number of control systems capable of driving the servomotor 215, one embodiment of a control system suitable for such use is illustrated in FIG. 2. The embodiment of the control system illustrated here will be described generally below. Further details relating to this control system can be found in U.S. Ser. No. 08/315,414, filed Sep. 28, 1994, entitled "Control System For A Packaging Machine" (Attorney Docket No. 10623US01) which is hereby incorporated by reference.

The illustrated control system includes a controller, shown generally at 225. The controller 225 of the present embodiment includes a programmable logic controller (PLC) 230, an example of which is the commercially available PLC manufactured by GE Fanuc, and/or a programmable axis manager (PAM) 235, an example of which is one available from Socapel. One or both of these units may be used depending on the demands placed on the system. Controller 225 may also include an industrial PC 240 and an I/O interface unit 245. The PLC 230, PC 240, PAM 235, and I/O interface unit 245 may all be disposed in a bus rack 250 for communication with one another. The bus rack 250 may be a VME bus, a SIMTAC S5 bus, or any other bus that is capable of supporting multiple processors.

As illustrated, the PLC 230 includes a ROM 255 and a RAM 260. The ROM 250 includes, for example, the software that is required to program and run the PLC 230 and, for example, may include E2 PROM for storing the ladder logic programming and motion profiles associated with the components being driven by the control system including, for example, the motion profiles that are to be executed by the servomotor 215. The PAM 235 includes a ROM 265 and a RAM 270. The ROM 265 includes the programs necessary to operate and program the PAM 235 and, for example, may include E2 PROM for storing the user program, including motion profiles associated with the various components that are to be driven by the control system, including, for example, the motion profiles that are to be executed by the servomotor 215.

The user of the packaging machine may select the desired volume and/or product specifications (i.e., product type, machine speed, etc.) through the operator control panel. The control system 225 then directs the servomotor 215, through commands to the corresponding servo amplifier 290, to execute the desired fill volume and fill profile required to fulfill the user's specifications. Coordination of the operation of the inlet and outlet valves 45 and 50 with the operation of the drive 55 may be accomplished through control signals supplied to the pneumatic drives by, for example, the I/O unit 245, or one or more of the I/O units 295.

In operation, the inlet valve 45 is opened and the pump mechanism 25 is operated to draw the required volume of product from the product tank 15 into the pump chamber 40. The inlet valve 45 is then closed and the outlet valve 50 is opened while the pump mechanism 25 is operated to pump the desired amount of product through the dispensing mechanism 30 and into a carton disposed beneath the nozzle 155.

Figure 3:
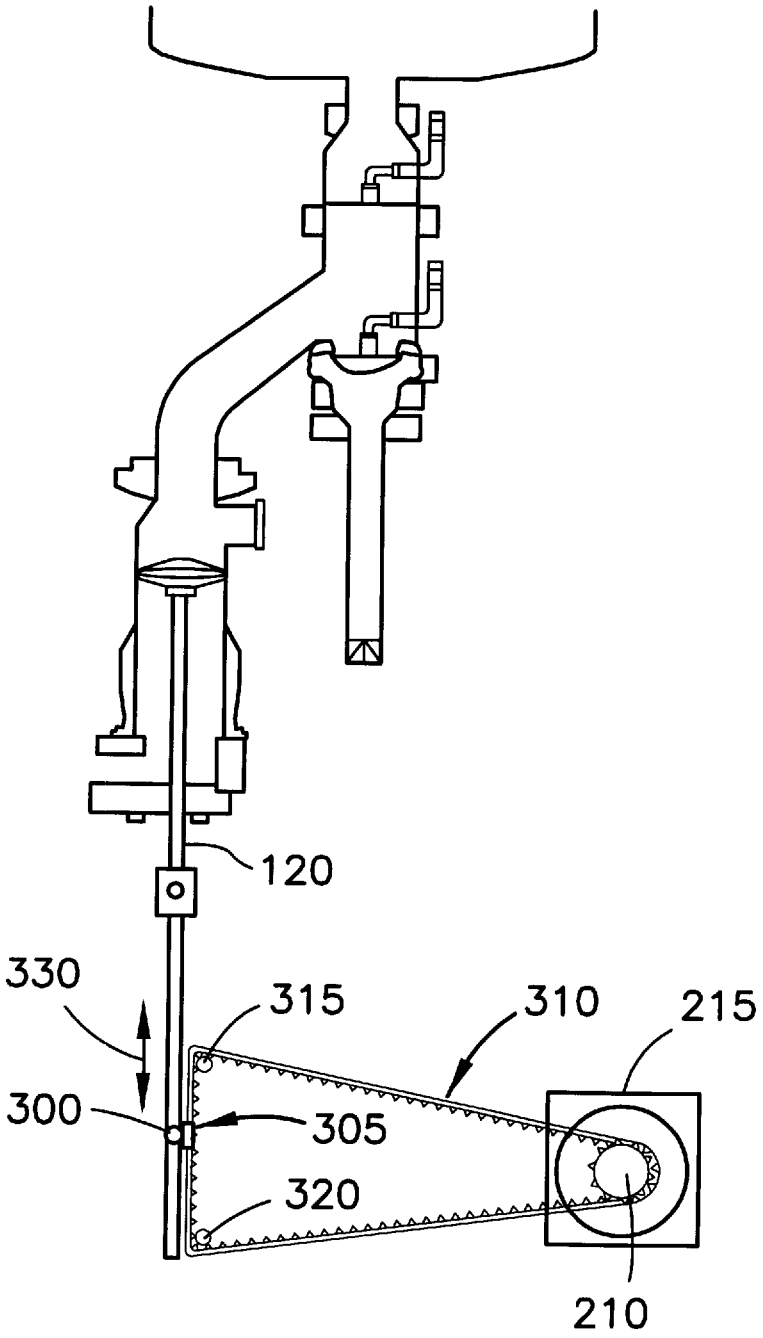
FIG. 3 is a front elevation of the filling station constructed in accordance with a further embodiment of the present invention.

An alternative embodiment of the present filling station is depicted in FIG. 3. In the embodiment illustrated there, the cam 185 of the embodiment of FIG. 1 is not utilized. Instead, the piston rod 120 is attached to a shaft 170 that, in turn, is attached at joining section 300 to a linearly running section 305 of a drive linkage 310. As illustrated, the drive linkage 310 is in the form of a toothed belt or chain. The linear section 305 is formed by running the linkage 310 about two freely rotatable shafts 315 and 320. The linear section 305 should be of sufficient length to accommodate the greatest desired piston stroke length. In operation, the servomotor 215 is operated to drive the linkage 310 to produce a linear translation of the piston 95 in the directions of arrows 330 in accordance with a programmed fill profile, preferably, in a reciprocating manner.

An alternative modification of the embodiment of FIG. 3 may involve the use of a linkage 310 having teeth disposed on an external portion thereof. Such teeth may engage corresponding teeth on or attached to the shaft 170 along the linear section 305.

Figure 4A:
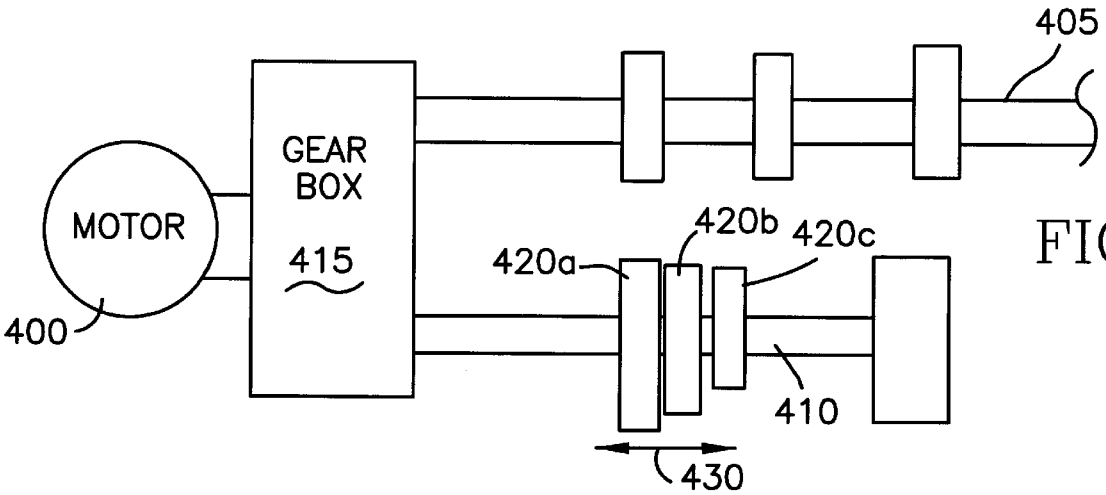
FIGS. 4A–4C illustrate one embodiment of an existing packaging machine that can be retrofitted with the fill systems of FIGS. 1 and 3.
Figure 4B:
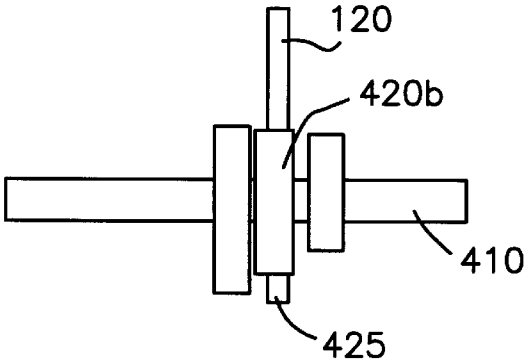
Figure 4C:
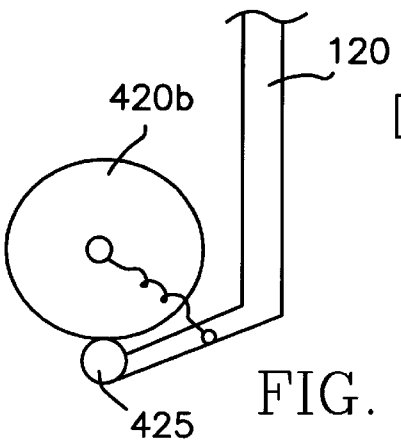

The foregoing systems can be used in new machine designs and, further, in retrofit designs. One existing design for which the presently described systems provide a suitable retrofit is illustrated in FIGS. 4A–C. FIG. 4A is a top plan diagram of a drive mechanism of a packaging machine, such as one of those sold by Tetra Pak, Inc. under the trademarks TR/7™ and TR/8™. As shown, a single electric motor 400 is operated at a constant rate during a production cycle to drive a main drive shaft 405 and fill cam shaft 410 through a corresponding gear box 415. The main drive shaft 405 is used, for example, to index a conveyor supporting the cartons between the various processing stations of the machine. The fill cam shaft 410 supports a plurality of fill cams 420A, 420B and 420C each having a unique fill profile. Engagement between one of the existing cams 420A, 420B and 420C and the piston rod 120 ensues through a cam follower 425 and is illustrated in FIGS. 4B and 4C.

The number of fill volumes that may be executed by the machine of FIGS. 4A–C are limited to the number of cams 420A, 420B and 420C disposed on the cam shaft 410. A change between the available volumes requires movement of the cam shaft 410 in the directions of arrows 430 until the desired cam 420 engages the follower 425.

The improved systems described herein may be retrofitted to the existing machines of the type shown in FIGS. 4A–C. In such a retrofitting operation, the cam shaft 410 is either cut or removed and replaced by one of the piston drive mechanisms shown in FIGS. 1 and 3. The piston 120 may be entirely replaced, cut and joined with shaft 170, or used to directly engage the closed cam surface of cam 185 or joining section 300. It should be recognized therefore that the term "piston rod", as used herein, contemplates any one or more rods that are joined to the piston head.

Figure 5:
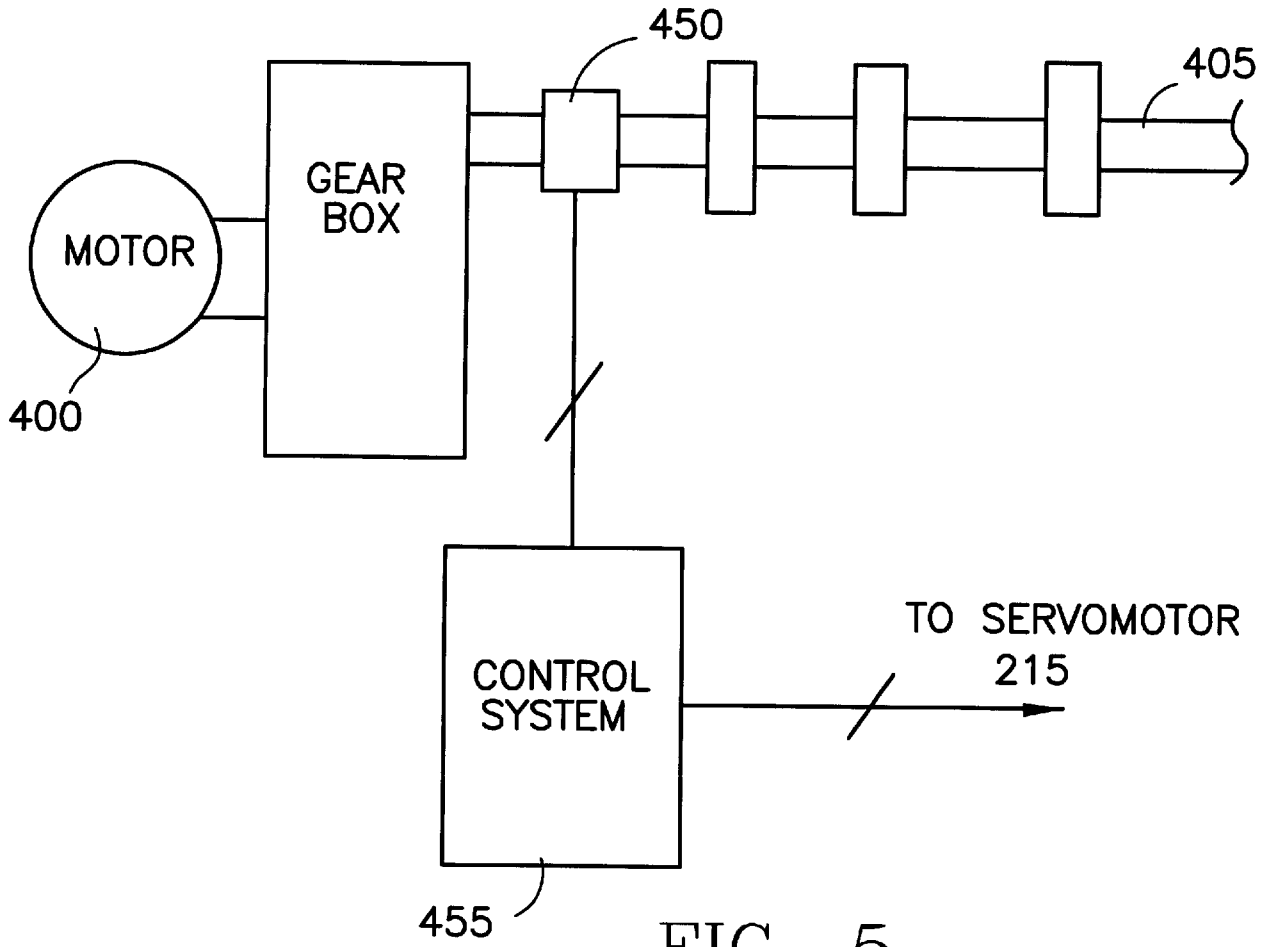
FIG. 5 illustrates one manner in which the control system can be coordinated to execute fill profiles in timed relationship with the carton indexing.

FIG. 5 illustrates a modification to an existing machine that can be made to ensure coordination between the indexing of the cartons through the packaging machine and the dispensing of product from the fill system 10. As shown, a resolver 450 may be attached to the main drive shaft 405 to monitor its rotation. The output of the resolver 450 is supplied to the input of the control system 455 (without limitation, such as the one described above) that is used to control the servomotor 215. The control system is thus made aware of the status of the indexing process and can provide the timing coordination required to execute the fill profile so that product is properly dispensed from the fill system during the time in which a carton is disposed thereat.

Although the present invention has been described with reference to a specific embodiment, those of skill in the art will recognize that changes may be made thereto without departing from the scope and spirit of the invention as set forth in the appended claims.

I claim:

1. A fill system for filling a series of containers with a product in a packaging machine, the fill system comprising:

a product tank containing a supply of product;

a piston chamber for receiving and holding a volume of product received from the product tank that is to be dispensed into each of the containers;

a pneumatically controlled inlet valve disposed between the product tank and the piston chamber, the pneumatically controlled inlet valve operating in open and closed positions;

a pneumatically controlled outlet valve disposed between the piston chamber and a dispensing mechanism, the pneumatically controlled outlet valve operating in open and closed positions;

a piston assembly disposed in the piston chamber and movable linearly therein along a piston stroke length, variations in the piston stroke length varying the volume of product received and dispensed from the piston chamber, the piston assembly comprising a piston head and a piston rod;

a cam follower in fixed alignment with the piston rod, movement of the cam follower resulting in movement of the piston rod and piston head;

a cam having a closed cam track in which the cam follower is disposed;

a cam shaft connected for co-rotation with the cam;

a servomotor;

a drive linkage connecting the servomotor and the cam shaft;

whereby when a volume of product is received into the piston chamber the inlet valve is in an open position and the outlet valve is in a closed position, and when the product is dispensed from the piston chamber the inlet valve is in a closed position and the outlet valve is in an open position.

2. A fill system as claimed in claim 1 and further comprising a control system connected to control the servomotor to execute a plurality of fill profiles.

3. A fill system as claimed in claim 1 wherein the closed cam track is a spiral closed cam track.

4. A fill system as claimed in claim 1 wherein the drive linkage comprises a toothed belt.

5. A fill system as claimed in claim 4 wherein the toothed belt extends between a rotating shaft of the servomotor and the camshaft.

6. A fill system as claimed in claim 1 wherein the drive linkage is a chain.

7. A fill system for filling a series of containers with a product in a packaging machine, the fill system comprising:

a product tank containing a supply of product;

a piston chamber for receiving and holding a volume of product received from the product tank that is to be dispensed into each of the containers;

a pneumatically controlled inlet valve disposed between the product tank and the piston chamber, the pneumatically controlled inlet valve operating in open and closed positions;

a pneumatically controlled outlet valve disposed between the piston chamber and a dispensing mechanism, the pneumatically controlled outlet valve operating in open and closed positions;

a piston assembly disposed in the piston chamber and movable linearly therein along a piston stroke length, variations in the piston stroke length varying the volume of product received and dispensed from the piston chamber, the piston assembly comprising a piston head and a piston rod;

a cam follower in fixed alignment with the piston rod, movement of the cam follower resulting in movement of the piston rod and piston head;

a cam having a cam surface engaging the cam follower;

a cam shaft connected for co-rotation with the cam;

a servomotor;

a drive linkage connecting the servomotor and the cam shaft;

whereby when a volume of product is received into the piston chamber the inlet valve is in an open position and the outlet valve is in a closed position, and when the product is dispensed from the piston chamber the inlet valve is in a closed position and the outlet valve is in an open position.

8. A fill system as claimed in claim 7 and further comprising a control system connected to control the servomotor to execute a plurality of fill profiles.

9. A fill system as claimed in claim 7 wherein the closed cam track is a spiral closed cam track.

10. A fill system as claimed in claim 7 wherein the drive linkage comprises a toothed belt.

11. A fill system as claimed in claim 10 wherein the toothed belt extends between a rotating shaft of the servomotor and the cam shaft.

12. A fill system as claimed in claim 7 wherein the drive linkage is a chain.

* * * * *